US006307509B1

(12) United States Patent
Krantz

(10) Patent No.: US 6,307,509 B1
(45) Date of Patent: Oct. 23, 2001

(54) PATCH ANTENNA WITH CUSTOM DIELECTRIC

(75) Inventor: Eric Krantz, Redwood City, CA (US)

(73) Assignee: Trimble Navigation Limited, Sunnyvale, CA (US)

( * ) Notice: Subject to any disclaimer, the term of this patent is extended or adjusted under 35 U.S.C. 154(b) by 0 days.

(21) Appl. No.: 09/313,241

(22) Filed: May 17, 1999

(51) Int. Cl.[7] ..... H01Q 1/38
(52) U.S. Cl. ..... 343/700 MS
(58) Field of Search ..... 343/700 MS, 873; H01Q 1/38

(56) References Cited

U.S. PATENT DOCUMENTS 4,366,484 * 12/1982 Weiss et al. ..... 343/700 MS
4,977,406 * 12/1990 Tsukamoto et al. ..... 343/700 MS
5,319,378 * 6/1994 Nalbandian et al. ..... 343/700 MS
5,635,942 * 6/1997 Kushihi et al. ..... 343/700 MS
5,977,915 * 11/1999 Bergstedt et al. ..... 343/700 MS
6,034,637 * 3/2000 McCoy et al. ..... 343/700 MS

* cited by examiner

*Primary Examiner*—Michael C. Wimer
(74) *Attorney, Agent, or Firm*—Cooper & Dunham LLP; William E. Pelton; Donald S. Dowden

(57) ABSTRACT

An antenna comprises a signal radiator, a ground plane spaced apart from the radiator, and a dielectric separator between the radiator and the ground plane. The separator comprises at least two positions having different dielectric constants. In a preferred embodiment, it comprises a material such as FR-4 that has a dielectric constant and a loss tangent substantially higher than those of air and is formed with at least one void reducing the loss tangent of the separator. The antenna strikes an effective compromise between the dielectric constant and loss tangent and is well suited to transmit and receive GPS signals.

26 Claims, 11 Drawing Sheets

PATCH ANTENNA WITH CUSTOM DIELECTRIC

BACKGROUND OF THE INVENTION

1. Field of the Invention

This invention relates to antennas and, more particularly, to a novel and highly effective antenna that strikes an effective compromise between the dielectric constant and loss tangent of a separator provided between a signal radiator and a ground plane, and does so at an exceptionally low coast.

2. Description of the Prior Art

Those skilled in the art of antenna design are aware what there is a tradeoff between the dielectric constant and the loss tangent of a separator provided between the signal radiator and the ground plane of, for example, a patch antenna. A high dielectric constant is desirable because it enables reduction of the physical dimensions of the antenna. A low loss tangent is desirable because it enables an increase in the gain of the antenna. Unfortunately, measures taken to increase the dielectric constant tend to increase the loss tangent, and measures taken to reduce the loss tangent tend to reduce the dielectric constant.

Consider a plane wave propagating in a lossy dielectric. Maxwell's equations for a lossy region are $$V \times E = -j\omega\mu H$$

$$V \times H = j\omega\epsilon E + \sigma E$$

where E and H are the electric and magnetic fields, respectively, expressed as vectors; $\omega$ is the angular frequency; $\mu$ is the permeability; $\epsilon$ is the permitivity; and $\sigma$ is the conductivity. The second equation may be written in the form $$\nabla x H = j\omega\left(\epsilon + \frac{\sigma}{j}\omega\right)E$$
$$= j\omega\epsilon_c E$$

where $$\epsilon_c = \epsilon + \frac{\sigma}{j}\omega$$
$$= \epsilon' - j\epsilon''$$

The quantity $\epsilon'$ is called the relative dielectric constant and the ratio $\epsilon''/\epsilon'$ is called the loss tangent, denoted tan $\delta$. It is called a loss tangent because it is a measure of the ohmic loss in the medium and thus is a measure of the quality of the dielectric.

The dielectric constant affects the dimensions of the distributed circuit components, and the loss tangent affects the loss in the circuit. In the case of the a microstrip patch antenna, a higher dielectric constant allows the patch to be smaller; however, a higher loss tangent reduces the gain of the antenna. While the gain of an antenna is often more important than its size, one would like to obtain a dielectric material that had both a high dielectric constant (for small size) and a low loss tangent (for high gain). In conventional practice, less-than-ideal choices must often be made.

The dielectric constant and loss tangent of some commercial materials employed in a conventional manner are shown in Table 1.

TABLE 1

| MATERIAL | DIELECTRIC CONSTANT | LOSS TANGENT |
|---|---|---|
| Air | 1.00 | 0.0001 |
| RT/Duroid ® 5880 | 2.20 | 0.0009 |
| FR-4 | 4.20 | 0.0300 |

As Table 1 shows, air has a dielectric constant of 1.00 and a loss tangent of 0.0001. A patch antenna employing air as a separator may be taken as a reference to which other designs may be compared.

RT/Duroid® 5880, which is a registered trademark of Rogers Corporation for a material generically described as PTFE and reinforcing glass fibers, can also be employed as a separator between the signal radiator and the ground plane of a patch antenna. As Table 1 shows, RT/Duroid® 5880 has a dielectric constant of 2.20 and a loss tangent of 0.0009. While the dielectric constant is good, enabling a reduction in the size of the antenna as compared to an antenna employing air as the dielectric, the loss tangent is undesirably high and compromises the antenna gain. Moreover, RT/Duroid® 5880 is quite expensive and in many instances not economical for commercial use as a separator in a patch antenna assembly.

FR-4, which is a generic name for an inexpensive glass/epoxy laminate, described as a highly cross linked, brominated epoxy resin reinforced with woven glass cloth, can also be employed as a separator between the signal radiator and the ground plane of a patch antenna. As Table 1 shows, FR-4 has a dielectric constant of 4.20 and a loss tangent of 0.0300. While the dielectric constant is excellent, the loss tangent is high. Despite the low cost of FR-4, its high loss tangent renders it undesirable in conventional use as a separator between the radiating element and the ground plane of a patch antenna.

Many other materials have been tried as dielectric separators, but all have left something to be desired from the standpoint of dielectric constant, loss tangent, cost, weight, physical dimensions, or all of the above.

OBJECTS AND SUMMARY OF THE INVENTION

An object of the invention is to provide a separator for use between the radiating element and the ground plane of a patch antenna and that is constructed in such a manner as to have, separately and in combination:

a high dielectric constant;

a low loss tangent;

low weight;

small physical dimensions;

low cost.

Other objects of the invention are to provide an antenna employing such a separator and a method of employing the antenna especially to transmit or receive a GPS signal.

The foregoing and other objects are attained in accordance with one aspect of the invention by providing a dielectric separator for use in a patch antenna, wherein the separator comprises at least a first portion and a second portion, the first and second portions having dielectric constants that are different from each other.

In accordance with an independent aspect of the invention, there is provided a dielectric separator for use in a patch antenna, wherein the separator comprises a material that has a dielectric constant and loss tangent substantially higher than those of air and is formed with at least one void reducing the loss tangent of the separator. The material is preferably FR-4.

In accordance with another independent aspect of the invention, there is provided an antenna comprising a dielectric separator as described above.

In accordance with another aspect of the invention, there is provided a method comprising, as a step thereof, employing an antenna as described above to transmit or receive a signal, preferably a GPS signal.

The following features of the invention are also noteworthy:

The antenna is constructed as a patch antenna.

The material of which the separator is made has a dielectric constant higher than 2.00 and even as high as substantially 4.20 and a loss tangent of substantially 0.0300, and the void reduces the loss tangent of the separator to substantially 0.0004, while preserving a dielectric constant at least as high as 1.26.

The ratio of the area of the void to the area of the separator exceeds 0.1 and can be more than 0.9, so long as the signal radiator and ground plane are adequately supported.

The void is formed by a wall boundary to support dielectric material optimally provided above and below the void, or to support the radiating element and the ground plane directly. In accordance with the invention, there can be a single void having, for example, a star, hub-and-spoke, or serpentine shape, or a number of voids of hexagonal (honeycomb), rectangular (including square), triangular, elliptical (including circular), or other shape, or any combination of the above.

While the number and the shape of the void or voids have some importance from a structural and manufacturing standpoint, neither is critical to the invention as broadly conceived. The ratio of the area of the void(s) to the area of the separator is a more significant figure, since the void(s) in effect substitute the low loss tangent of air for the high loss tangent of the structural dielectric. The exact relationship between the effective dielectric constant and the amount of material remaining after the void(s) are formed is not precisely known but seems to be nonlinear.

BRIEF DESCRIPTION OF THE DRAWINGS

A better understanding of the objects, features and advantages of the invention can be gained from a consideration of the following detailed description of the preferred embodiments thereof wherein.

DESCRIPTION OF THE PREFERRED EMBODIMENTS

Figure 1:
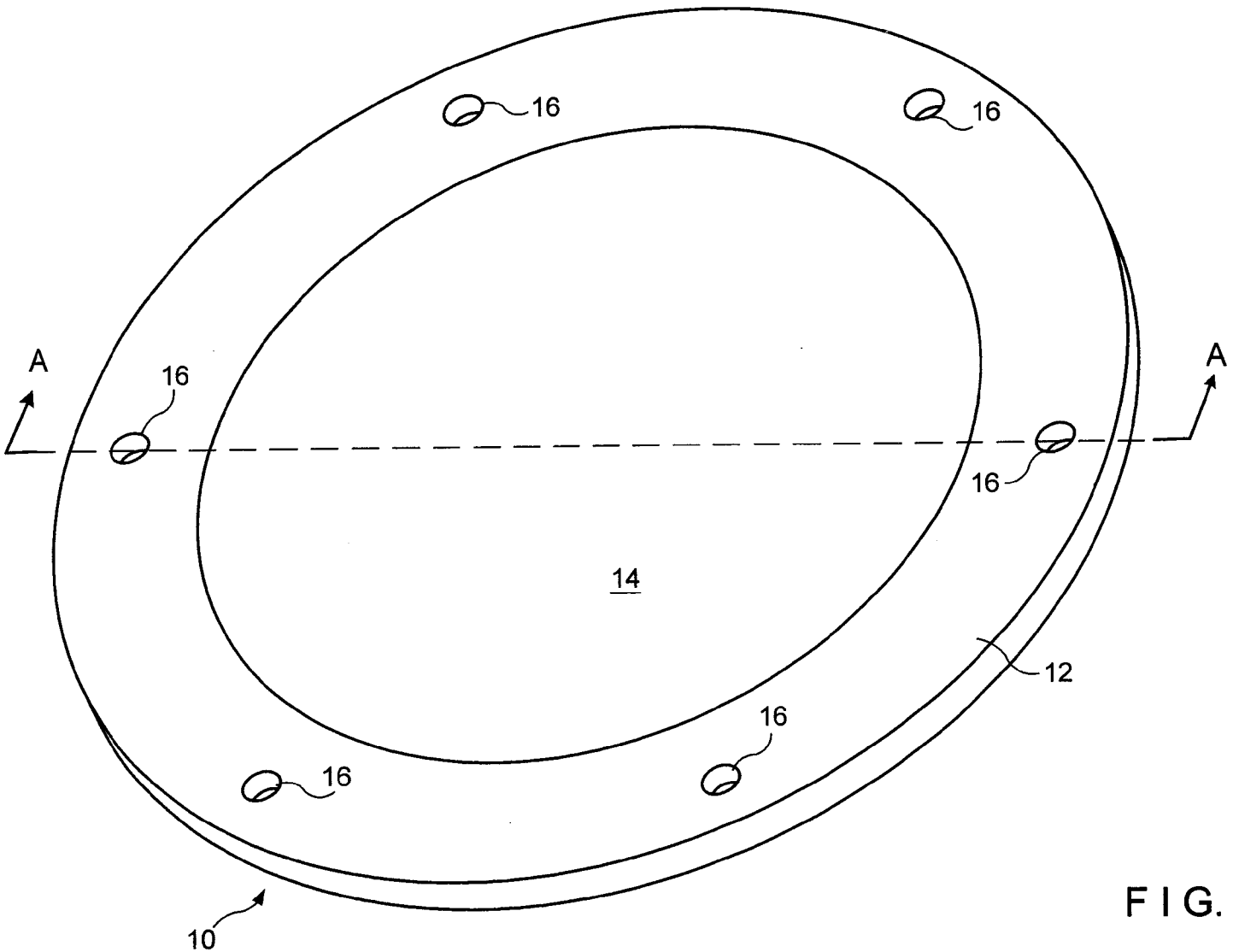
FIG. 1 is a perspective view of an antenna embodying the invention.

FIG. 1 shows a patch antenna 10 constructed in accordance with the invention. The antenna 10 is illustrated as circular, though it can also be square, rectangular without being square, or have some other shape, as those skilled in the art will appreciate. In FIG. 1, there is a peripheral part 12 having exposed dielectric, a metallized central part 14, and a plurality of mechanical mounting holes 16.

Figure 2:
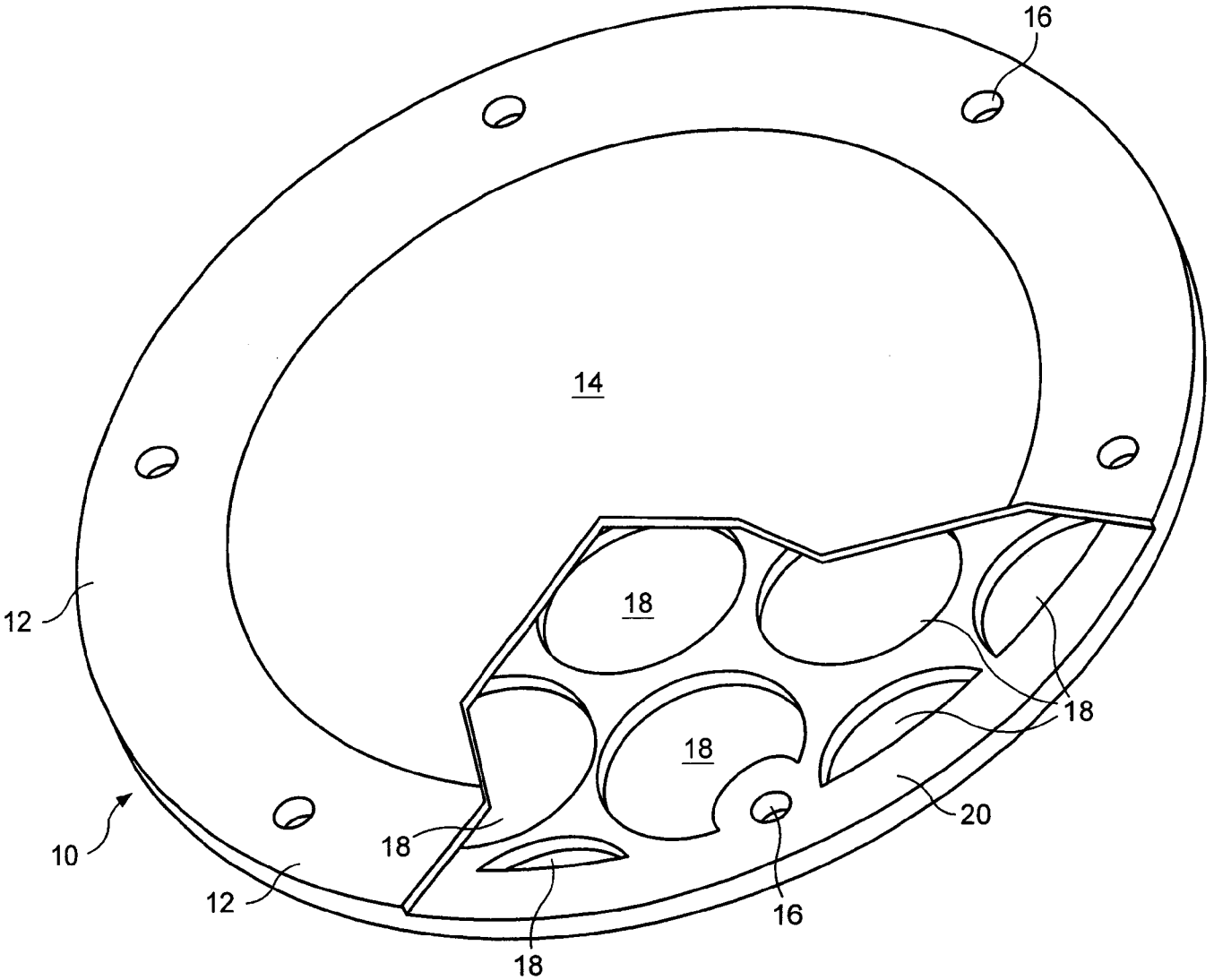
FIG. 2 is a perspective view similar to FIG. 1 but broken away to reveal some interior features.

In FIG. 2, parts 12, 14 are broken away to reveal a plurality of voids 18. The voids 18 are formed in a dielectric material 20 forming a separator.

As FIG. 2 shows, one portion of the separator is not cut away, and at least one other portion is cut away to form the void or voids 18. In a preferred embodiment of the invention, the first portion derives its dielectric constant at least partially from FR-4 and the second portion or portions derive their dielectric constant at least partially from air.

Figure 3:
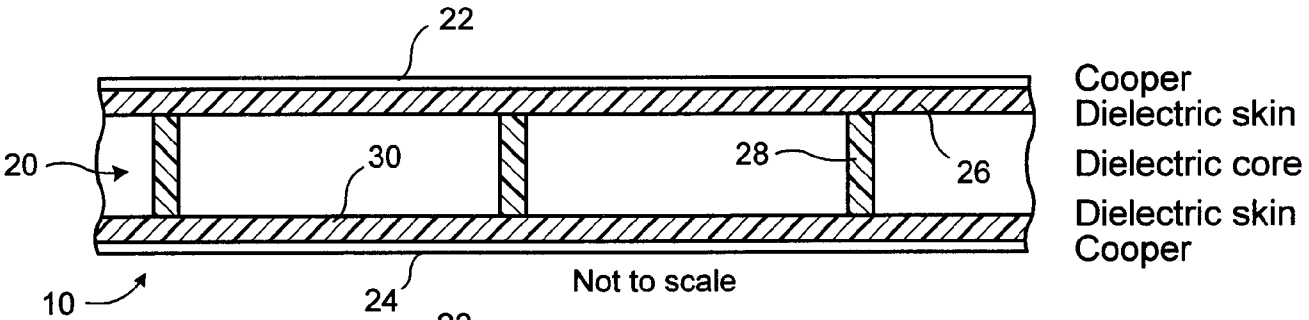
FIG. 3 is a view taken along the line 3—3 of FIG. 1 and looking in the direction of the arrows.

As FIG. 3 (drawn out of scale for better illustration) shows, the patch antenna comprises an upper sheet 22 made of copper, aluminum or another conductive material and serving as a signal radiator and a lower sheet 24 also made of copper, aluminum or another conductive material and serving as a ground plane. The dielectric separator 20 separates the radiator 22 from the ground plane 24.

The separator 20 comprises a material that has a dielectric constant and a loss tangent respectively higher than those of air and is formed with at least one void 18 reducing the loss tangent and dielectric constant of the separator. Preferably the material is FR-4, which is very inexpensive.

Table 2 shows a range of acceptable dielectric constants without any voids and loss tangents with and without void(s) in accordance with the invention.

TABLE 2

| Dielectric Constant without any Voids | Loss Tangent without any Voids | Loss Tangent with Void(s) |
|---|---|---|
| >2.00 | >0.0100 | <0.0100 |
| >3.00 | >0.0100 | <0.0010 |
| >3.00 | >0.0200 | <0.0010 |
| >4.00 | >0.0200 | <0.0005 |
| ≈4.20 | ≈0.0300 | ≈0.0004 |

In the last example, if the material is FR-4 and the ratio of the void area to the total area of the separator is about 0.6, the reduction of the dielectric constant of the separator is only to substantially 1.26, which is acceptably high.

Figure 4:
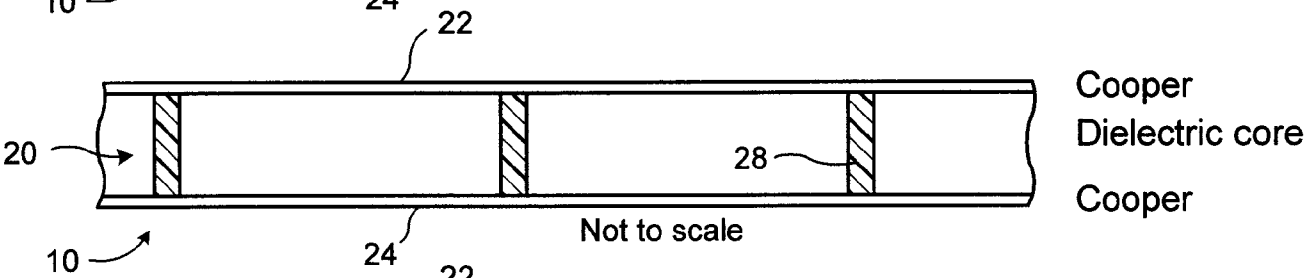
FIGS. 4–14 are respectively fragmentary or broken-away views showing various shapes of voids and other structures employed in accordance with the invention.
Figure 5:
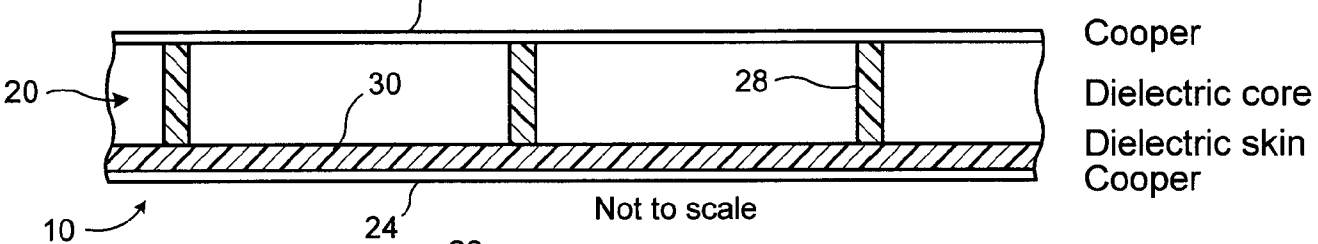
Figure 6:
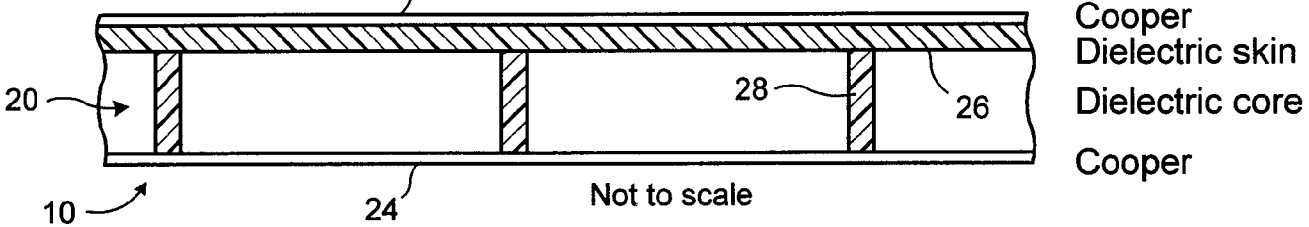

The void(s) are formed as hole(s) extending entirely through the separator material, as in FIG. 4, or entirely surrounded by the material, as in FIG. 3. Other possibilities are for the void(s) to open to the top side of the separator material but not the bottom side, as in FIG. 5, to open to the bottom side of the material but not the top side, as in FIG. 6, or any combination of the above.

Figure 7:
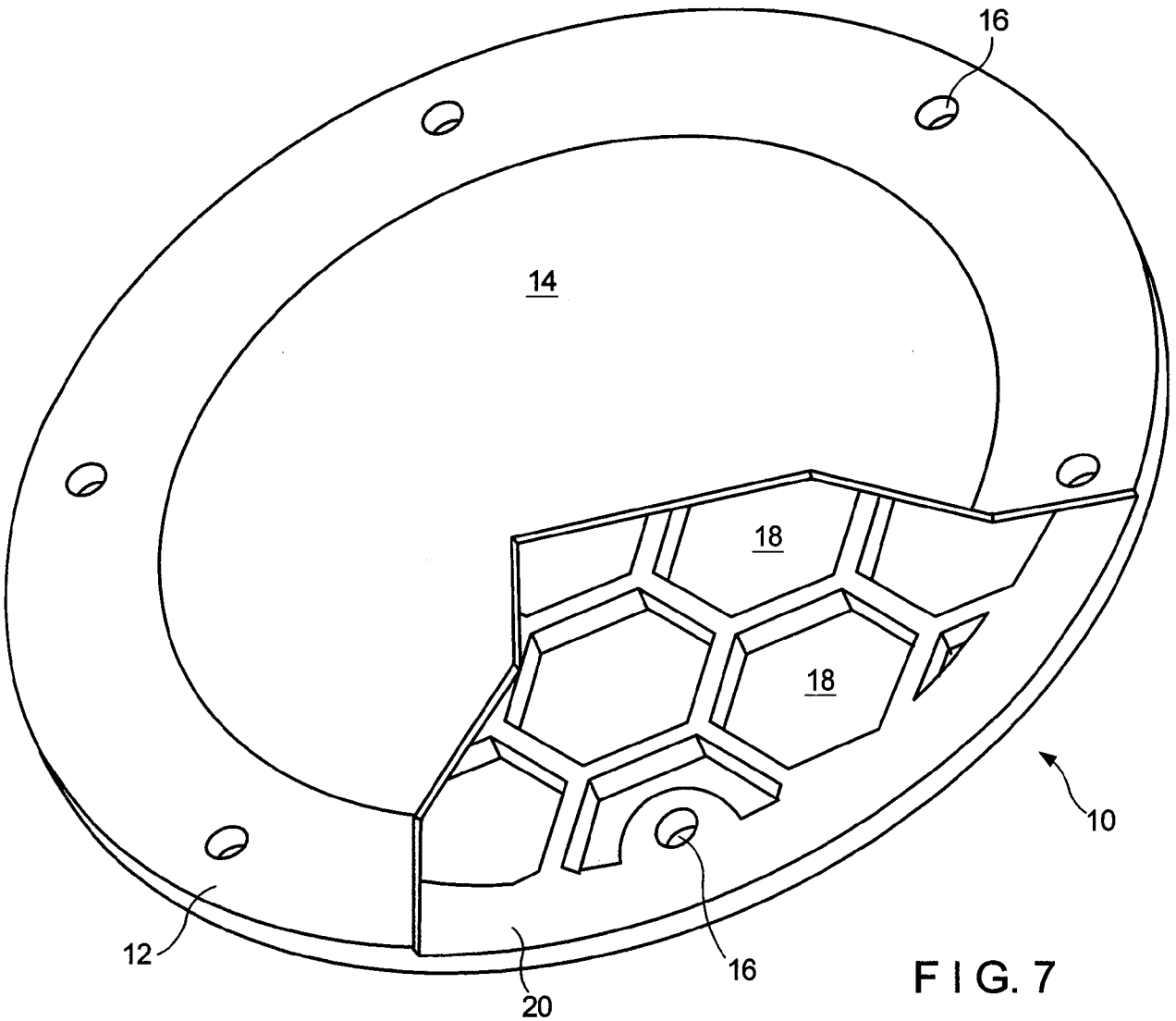
Figure 8:
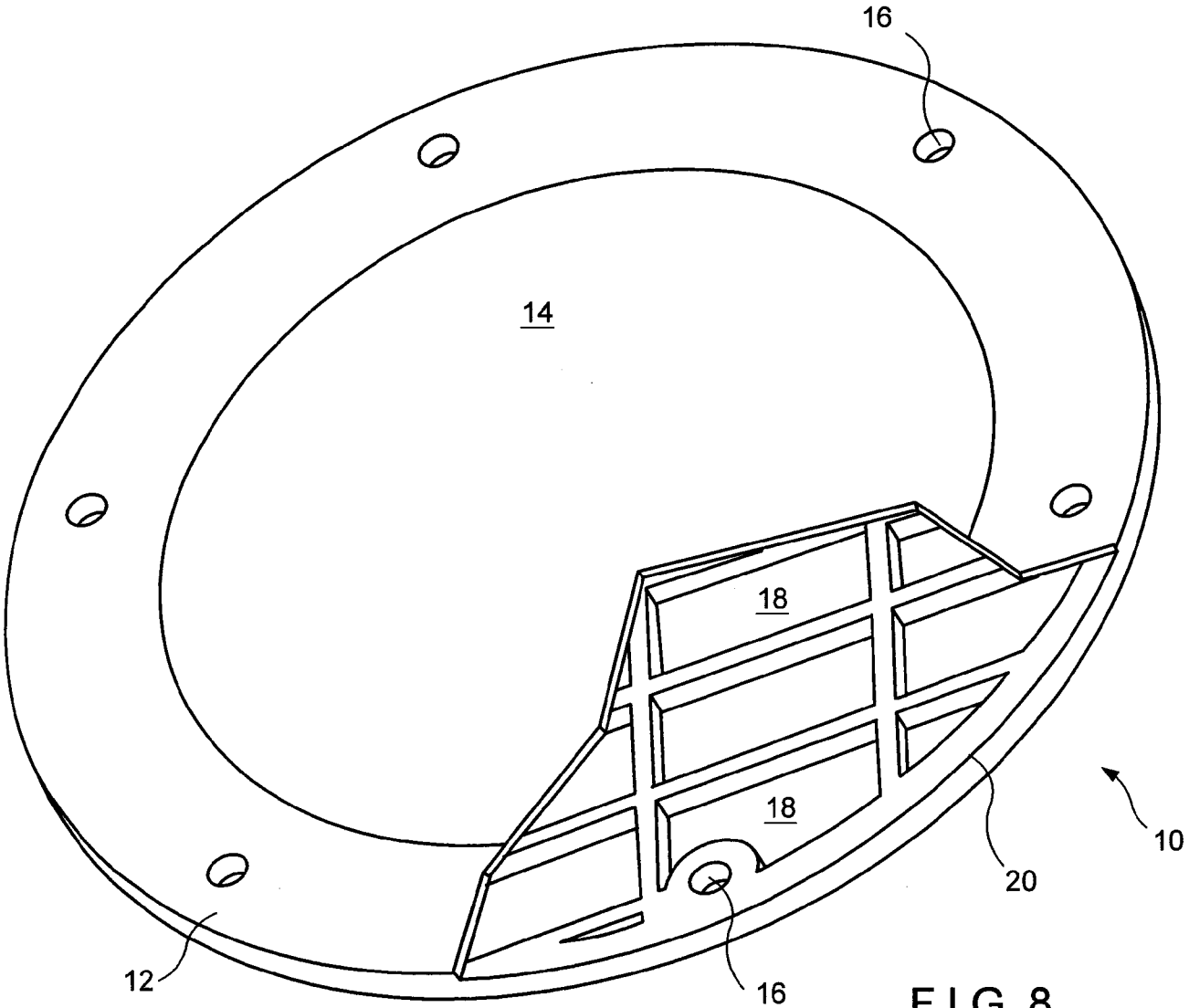
Figure 9:
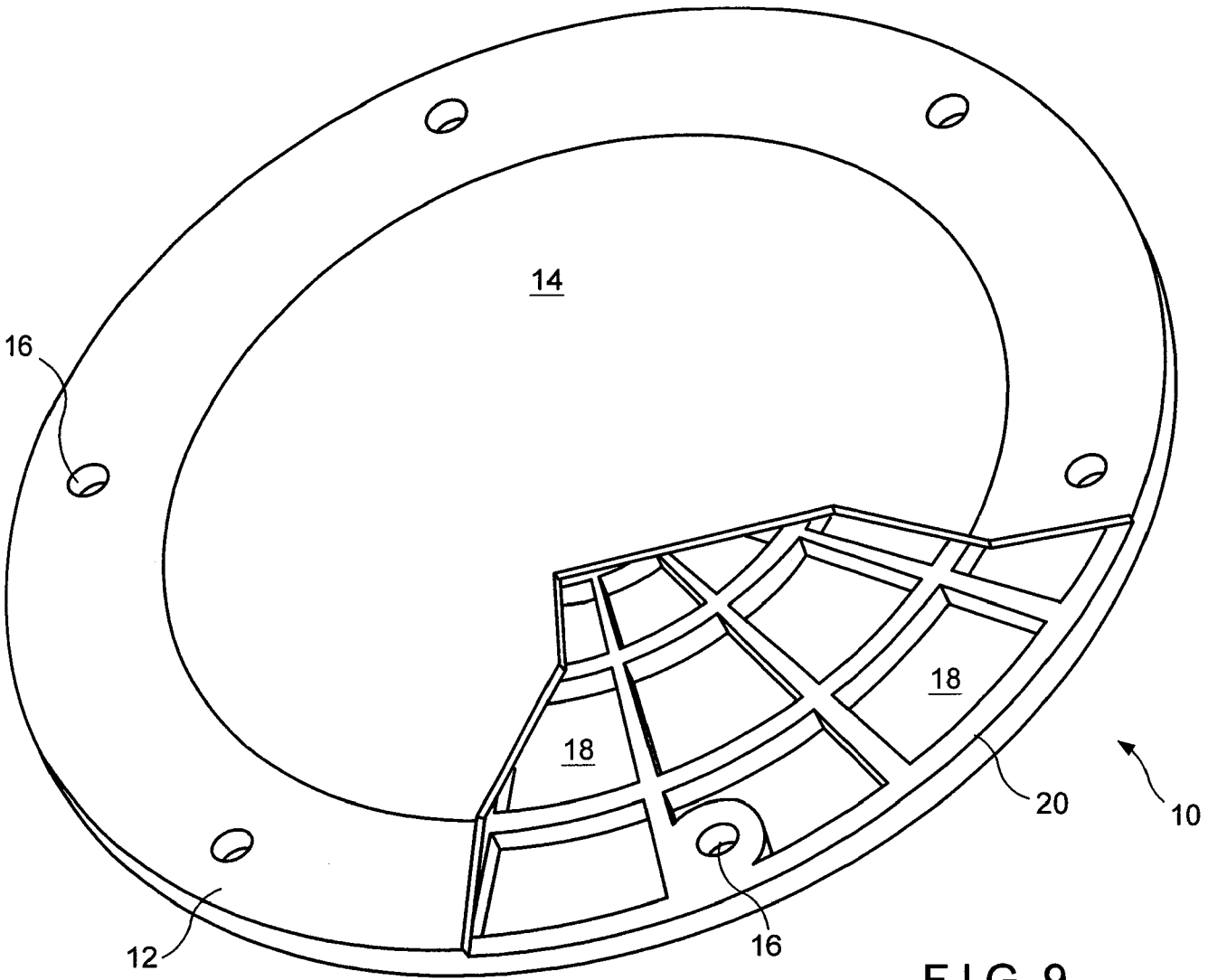
Figure 10:
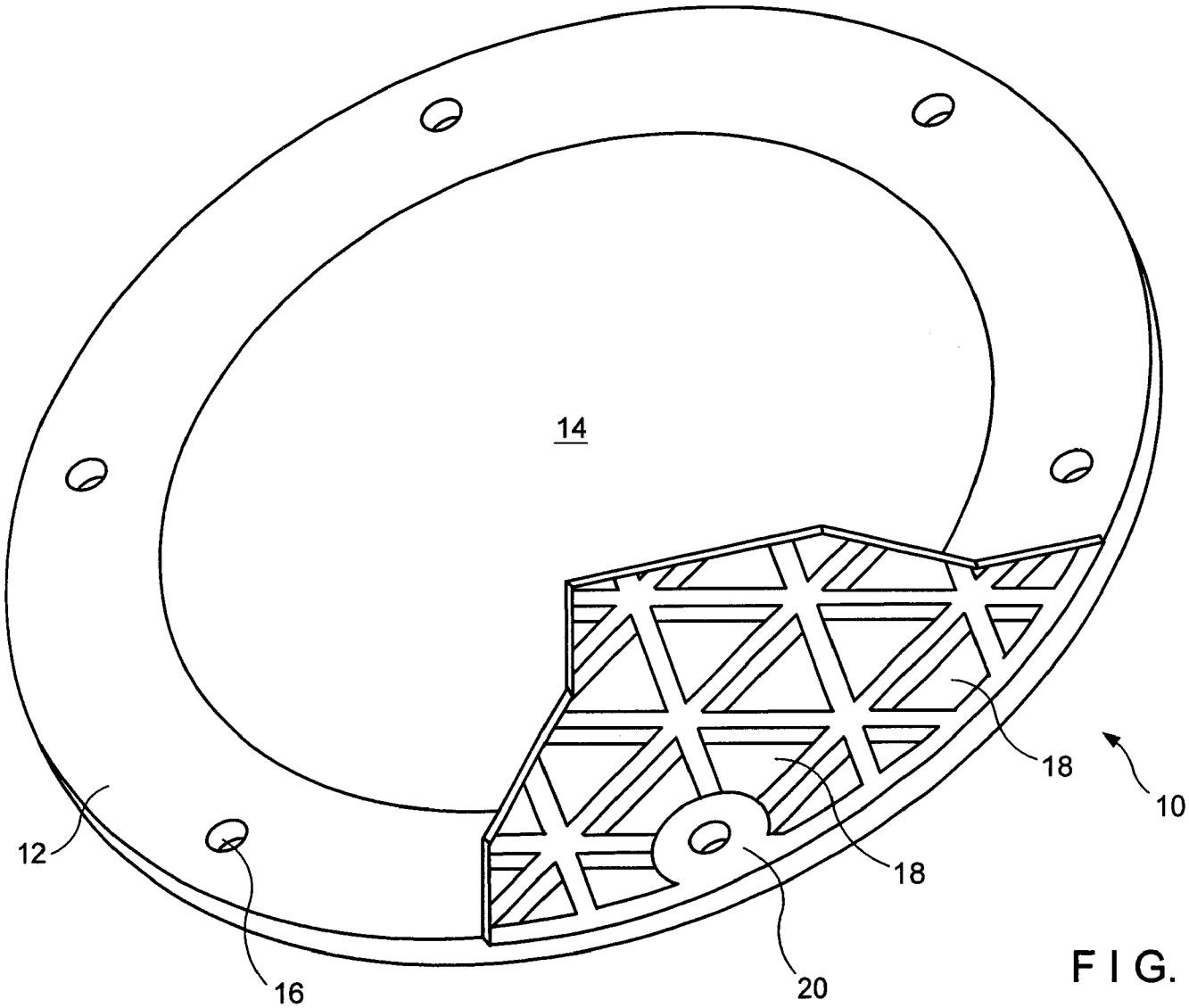
Figure 11:
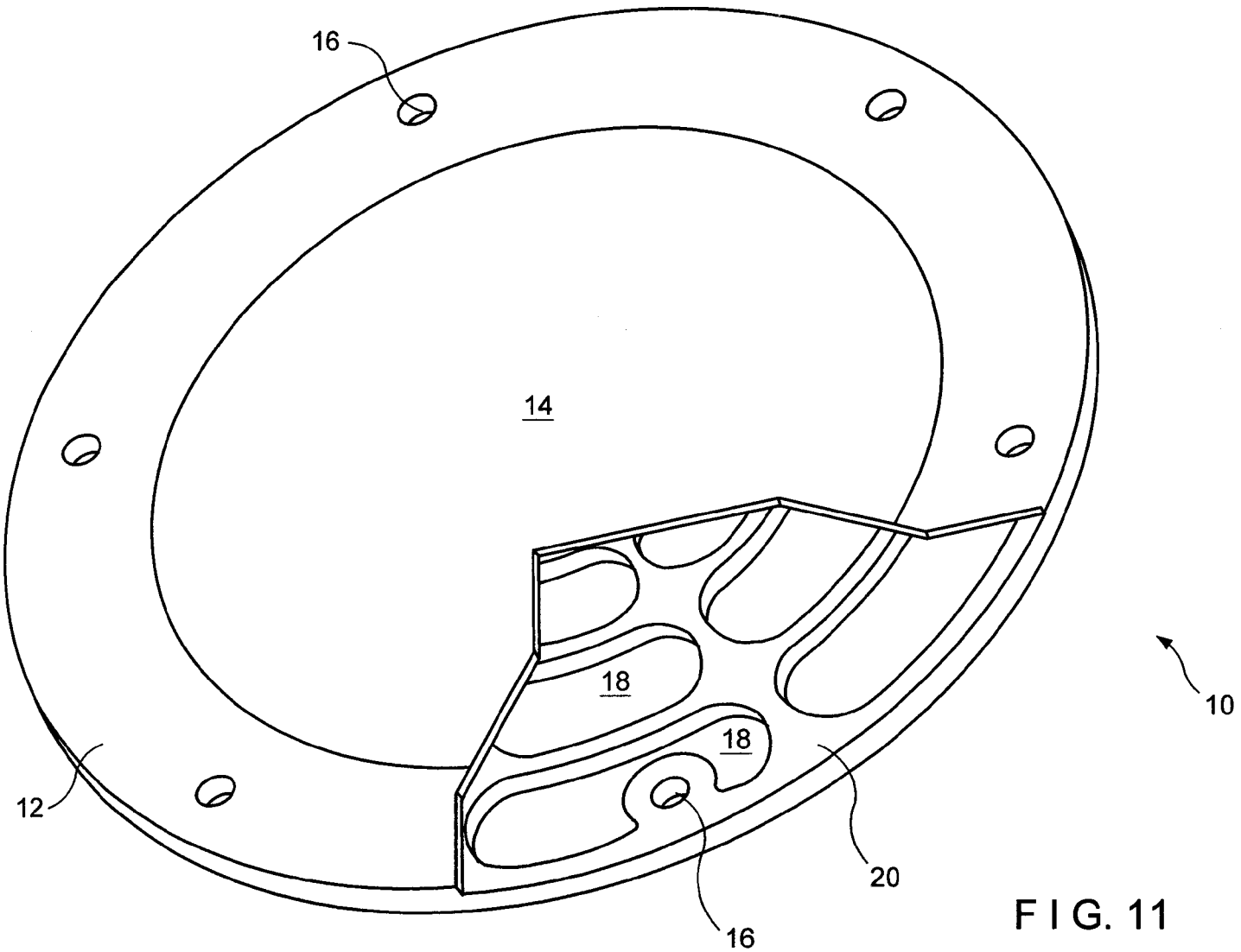
Figure 12:
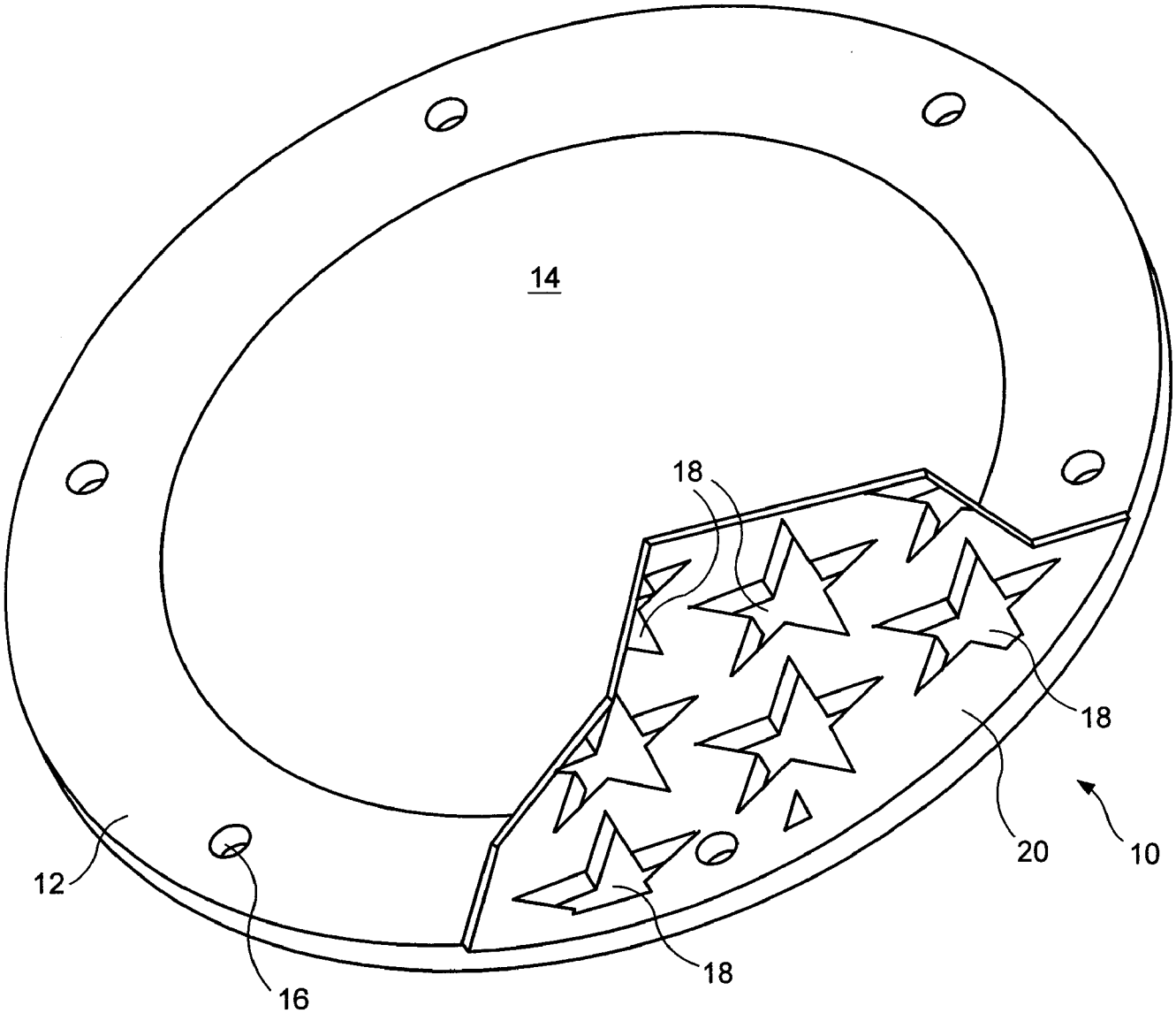
Figure 13:
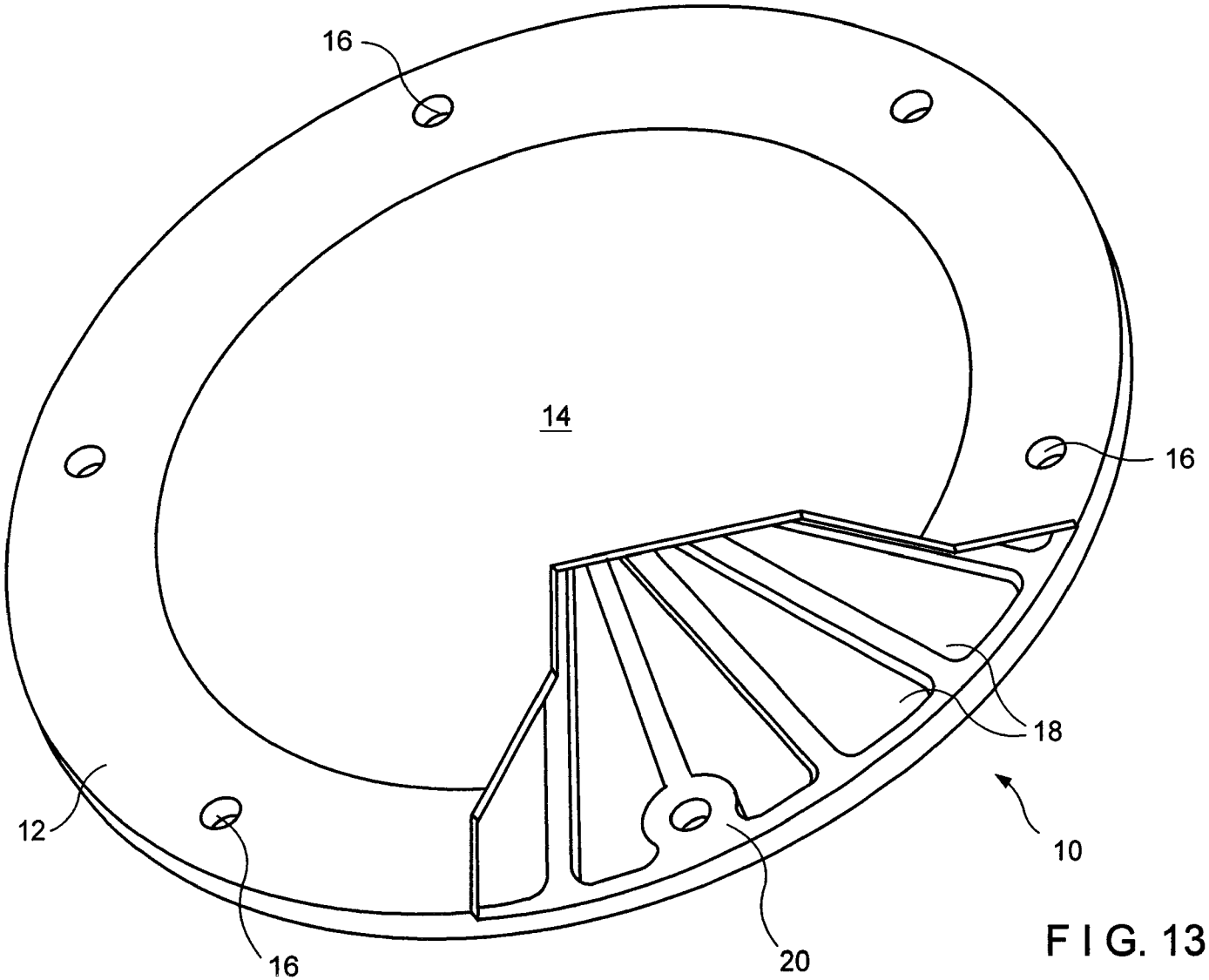
Figure 14:
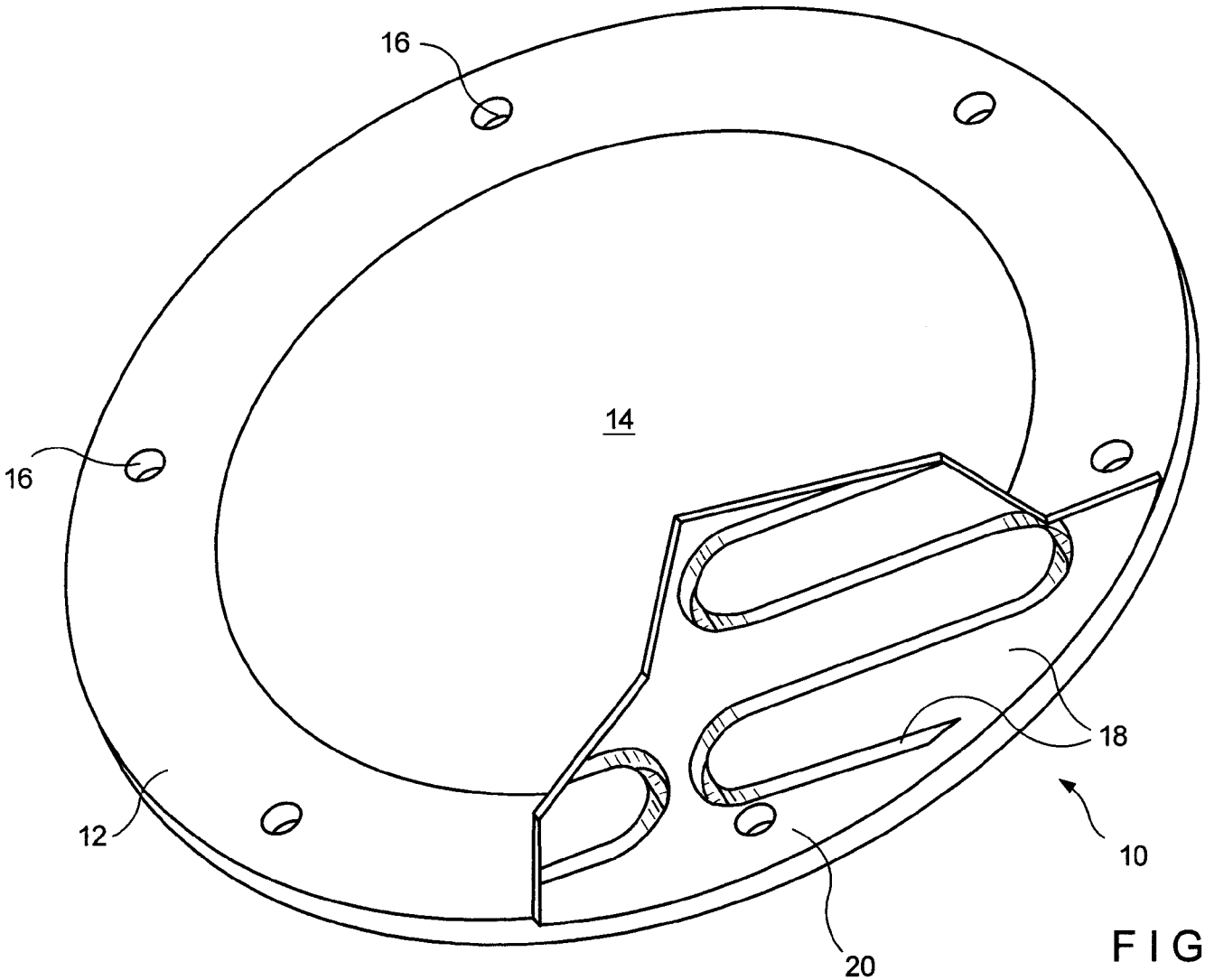

The void(s) can be substantially circular as in FIG. 2, hexagonal (honeycomb) as in FIG. 7, rectangular without being square as in FIG. 8, square as in FIG. 9, triangular as in FIG. 10, elliptical without being circular as in FIG. 11, or any combination of the above. There can also be one or more voids having, for example, a star shape as in FIG. 12, a hub-and-spoke shape as in FIG. 13 or a serpentine shape as in FIG. 14. Other shapes will readily suggest themselves to persons skilled in the art. For example, in all of the embodiments described above, "negatives" can be substituted: i.e., the void(s) can be filled in, and the filled-in portion(s) can be made void.

In a preferred embodiment of the invention, the separator is formed of three stacked layers of the dielectric material that are respectively thin, thick and thin, such as the layers 26, 28, 30 in FIG. 3. The void(s) are thus entirely enclosed within the dielectric material. The separator layers may have thicknesses within the ranges specified in Table 3:

TABLE 3

| Thickness of Top Layer | Thickness of Middle Layer | Thickness of Bottom Layer |
|---|---|---|
| <20 mil | >100 mil | <20 mil |
| <10 mil | >100 mil | ≦10 mil |
| ≈5–10 mil | ≈145 mil | ≈5–10 mil |

The overall thickness of the separator may be substantially 155 mil.

The separator in accordance with the invention can be formed with a multiplicity of voids, for example at least eight. The ratio of the area of the void or voids to the area of the separator is more than 0.1 and may be more than 0.9, subject to the requirement for structural support noted above. Where the material is FR-4, the ratio is ideally about 0.6. Table 4 shows some possible ratios in accordance with the invention.

TABLE 4

| Ratio of area of void(s) to area of separator |
|---|
| >1 |
| >0.2 |
| >0.3 |
| >0.5 |
| >0.7 |
| >0.9 |

The invention also includes a method comprising the steps of forming an assembly of a radiator, a ground plane spaced apart from the radiator, and a dielectric separator between the radiator and the ground plane, wherein the separator comprises a material such as FR-4 having a dielectric constant and a loss tangent respectively substantially higher than those of air and is formed with at least one void to reduce the loss tangent of the separator. The assembly is employed to transmit or receive a signal, especially a GPS signal.

The term "GPS signal" is employed in its broadest sense to include not only navigation signals transmitted by U.S. Government satellites but also signals employed in the Russian GLONASS navigation system and other such systems.

Thus there is provided in accordance with the invention a novel and highly effective antenna that attains the objects of the invention summarized above. Many other embodiments of the invention will occur to those skilled in the art upon consideration of the preceding disclosure. In particular, materials other than FR-4 can be employed for the separator, so long as their dielectric constant is acceptably high and their cost is acceptably low. In many applications, even an expensive material such as RT/Duroid® 5880 is acceptable in view of the material saving realized because of the voids. Also, a plurality of solid dielectric materials can be employed respectively in different portions of the separator, thereby dispensing with the void(s). In other words, another dielectric material can be substituted for one or more of the voids. The invention therefore includes all embodiments that fall within the scope of the following claims.

What is claimed is:

1. An antenna comprising a signal radiator, a ground plane spaced apart from the radiator, and a dielectric separator between the radiator and the ground plane, wherein the separator comprises FR-4 material formed with at least one void reducing the loss tangent of the separator to a value at least as low as 0.03 while maintaining the dielectric constant of the separator at a value at least as high as 1.26.

2. An antenna according to claim 1 wherein the radiator is a patch antenna.

3. An antenna according to claim 1 wherein the void reduces the loss tangent of the separator to a value lower than 0.0100.

4. An antenna according to claim 1 wherein the void reduces the loss tangent of the separator to a value lower than 0.0010.

5. An antenna according to claim 3 wherein the void reduces the loss tangent of the separator to a value lower than 0.0010.

6. An antenna according to claim 1 wherein the void reduces the loss tangent of the separator to a value lower than 0.0005.

7. An antenna according to claim 1 wherein the void reduces the loss tangent of the separator to substantially 0.0004.

8. An antenna according to claim 1 wherein the void reduces the dielectric constant of the separator to substantially 1.26 and the loss tangent of the separator to substantially 0.0004.

9. An antenna according to claim 1 wherein the void is formed as a hole extending entirely through the material.

10. An antenna according to claim 1 wherein the radiator and the ground plane are formed of copper.

11. An antenna according to claim 1 wherein the separator is formed of three stacked layers of the material that are respectively relatively thin, relatively thick and relatively thin.

12. An antenna according to claim 1 wherein the separator is formed of three stacked layers of the material that are respectively less than 20 mil, more than 100 mil, and less than 20 mil.

13. An antenna according to claim 1 wherein the separator is formed of three stacked layers of the material that are respectively equal to or less than 10 mil, more than 100 mil, and equal to or less than 10 mil.

14. An antenna according to claim 1 wherein the separator is formed of three stacked layers of the material that are respectively substantially 5 to 10 mil, substantially 145 mil, and substantially 5 to 10 mil.

15. An antenna according to claim 1 wherein the separator has a thickness of substantially 155 mil.

16. An antenna according to claim 1 wherein the separator is formed of three stacked layers of the material that are respectively relatively thin, relatively thick, and relatively thin, the thin layers serving as supports and the thick layer containing the void.

17. An antenna according to claim 1 wherein the ratio of the area of the void to the area of the separator is more than 0.1.

18. An antenna according to claim 1 wherein the ratio of the area of the void to the area of the separator is more than 0.2.

19. An antenna according to claim 1 wherein the ratio of the area of the void to the area of the separator is more than 0.3.

20. An antenna according to claim 1 wherein the ratio of the area of the void to the area of the separator is more than 0.5.

21. An antenna according to claim 1 wherein the ratio of the area of the void to the area of the separator is more than 0.7.

22. An antenna according to claim 1 wherein the ratio of the area of the void to the area of the separator is more than 0.9.

23. An antenna according to claim 1 wherein the separator is formed with a plurality of voids.

24. An antenna according to claim 1 wherein the separator is formed with at least 4 voids.

25. An antenna according to claim 1 wherein the separator is formed with at least 8 voids.

26. A method comprising the steps of forming an assembly of a radiator, a ground plane spaced apart from the radiator, and a dielectric separator between the radiator and the ground plane, choosing FR-4 as a separator material, reducing the loss tangent of the separator to a value at least as low as 0.03 by forming at least one void therein while maintaining the dielectric constant of the separator at a value at least as high as 1.26, and employing the assembly to transmit or receive a signal.

* * * * *